US005551211A

United States Patent [19]

Kennedy et al.

[11] Patent Number: 5,551,211

[45] Date of Patent: Sep. 3, 1996

[54] VACUUM OPERATED BOTTOM FORMER

[76] Inventors: Paul Kennedy, 795 Brookfield Ct., Lake Zurich, Ill. 60047; Richard Prochut, 950 Baytree Dr., Bartlett, Ill. 60103; Jörgen Löfstedt, 1125 Sterling Ave. #220, Palatine, Ill. 60067; Ikuro Yokoyama, 1405 E. Central Rd., Arlington Heights, Ill. 60005; Christer Nilsson, 1423 W. Concord Dr., Arlington Heights, Ill. 60004

[21] Appl. No.: 315,403

[22] Filed: Sep. 28, 1994

[51] Int. Cl.[6] ..... B65B 51/10

[52] U.S. Cl. ..... 53/371.7; 53/372.2; 53/377.3; 493/141

[58] Field of Search ..... 493/129, 130, 493/141, 157, 295, 308; 53/371.7, 372.2, 377.3, 559, 560

[56] References Cited

U.S. PATENT DOCUMENTS

| | | | |
|---|---|---|---|
| 3,038,282 | 6/1962 | Hansen et al. | 53/560 |
| 3,236,160 | 2/1966 | Mullaney | 493/141 |
| 3,438,176 | 4/1969 | Reil et al. | 53/372.2 |
| 3,958,394 | 5/1976 | Mahaffy et al. | 53/559 |
| 4,229,927 | 10/1980 | Day | 53/559 |
| 5,205,110 | 4/1993 | Buchko | 53/559 |

*Primary Examiner*—John Sipos
*Assistant Examiner*—Ed Tolan
*Attorney, Agent, or Firm*—McAndrews, Held & Malloy, Ltd.

[57] ABSTRACT

An apparatus for forming a flattened seating area from a gabled bottom of a carton. The apparatus includes a cup having a recess that conforms to the bottom cross-section of the gabled bottom. The cup has an inlet in fluid communication with an underpressure source. An anvil is disposed within the cup recess for forming the carton when the carton bottom and anvil are driven together by, for example, the underpressure in the cup.

32 Claims, 17 Drawing Sheets

VACUUM OPERATED BOTTOM FORMER

TECHNICAL FIELD

The present invention relates to an apparatus for forming a bottom of a package, and more particularly an apparatus for forming the bottom of gabled bottom container.

BACKGROUND

Gable top cartons have been known for the better part of the twentieth century. Their characteristic simplicity and resealability have helped to sustain their popularity as cartons for traditional liquid food products such as milk and juice, but in recent years they have been used for products ranging from ammunition to Epsom salts. Gable top cartons typically start out as generally rectangular carton blanks made of laminated paperboard or similar material. The carton blanks are provided with a number of creases to facilitate folding and forming the blank into a carton.

During decades of development, manufacturers of packaging machines have devised a variety of ways to form, fill and seal gable top cartons. Today, the most prevalent packaging machines for filling and sealing gable top cartons are adapted to receive the carton blank after it has been side sealed. The process of side sealing involves sealing opposite vertical edges of the carton blank together to form a polygonal (usually rectangular) sleeve. The sleeve is received on an indexable mandrel wheel which rotates the sleeve into respective positions where the end of the sleeve extending outwardly from the mandrel is folded and sealed to form the bottom of the carton.

After the carton bottom has been formed, it is removed from the mandrel and transported to a filling station where the carton is filled with product. Once the carton has been filled, the top of the carton is folded into the familiar gable top configuration and is heat sealed, thus completing the packaging process.

One example of a known packaging machine that operates generally in accordance with these principles is described in U.S. Pat. No. 3,789,746 to Martensson et at. Other examples of such packaging machines are described in U.S. Pat. No. 3,820,303 to Martensson et al., U.S. Pat. No. 4,759,171 to Bruveris et al., and U.S. Pat. No. 4,790,123 to Ljungstr öm et al.

The use of mandrels for forming the bottoms of cartons limits the speed with which the bottom of the carton is capable of being formed, limits the maximum size of the system necessary to carry out the bottom forming process, and necessitates direct contact between the mandrel and the inside of the carton. A single mandrel is capable of forming only one bottom at a time. Increasing the speed of the bottom forming process requires introduction of multiple mandrels resulting in potentially inefficient use of space and energy. In addition to problems of space and energy efficiency, contact between the inside of the carton and the mandrel during the forming process compromises the hygiene of the container. Furthermore, introduction of the mandrel into the carton interior creates a risk of damage to the thermoplastic layer of the carton which comprises proper package formation and functionality.

Trends within the field of packaging machines point toward increasingly high capacity, hygienic machines, intended for rapid, continuous filling and sealing of a very large number of identical or similar packaging containers, e.g., containers of the type intended for liquid contents such as milk, juice, and the like. One such machine is disclosed in U.S. Ser. No. 08/190,546, filed Feb. 2, 1994, which is hereby incorporated by reference. The '546 application discloses, among other things, a mandrel-less packaging machine that utilizes a carton having a gabled bottom that is first sealed and then compressed to form a bottom on which the carton may rest. This is opposed to the mandrel-formed bottoms of prior cartons. An alternative bottom forming mechanism to the one described in the '546 application is set forth.

SUMMARY OF THE INVENTION

An apparatus for forming a flattened seating area from a gabled bottom of a carton. The apparatus includes a cup having a recess that conforms to the bottom cross-section of the gabled bottom. The cup has an inlet in fluid communication with an underpressure source. An anvil is disposed within the cup recess for forming the carton when the carton bottom and anvil are driven together by, for example, the underpressure in the cup.

In accordance with one embodiment of the apparatus, an anvil may operate as part of an ejecting mechanism. To this end, the anvil may be connected to a piston that passes through the bottom of the cup, with a bumper connected to the opposite end of the piston. A strike plate is located below the cup in a position that allows the bumper to impact the top of the strike plate. A drive mechanism, capable of moving the cup up and down, creates relative movement between the strike plate and piston bumper causing the piston to drive upward into the cup to eject the carton.

The apparatus further may include a heating mechanism for pre-heating the gabled bottom of the carton prior to the engagement of the carton and the anvil. The heating mechanism may be located above the cup and include a drive mechanism that moves the cup between a first position distal the heating mechanism and a second position proximate the heating mechanism.

DETAILED DESCRIPTION OF THE PREFERRED EMBODIMENT

Figure 1:
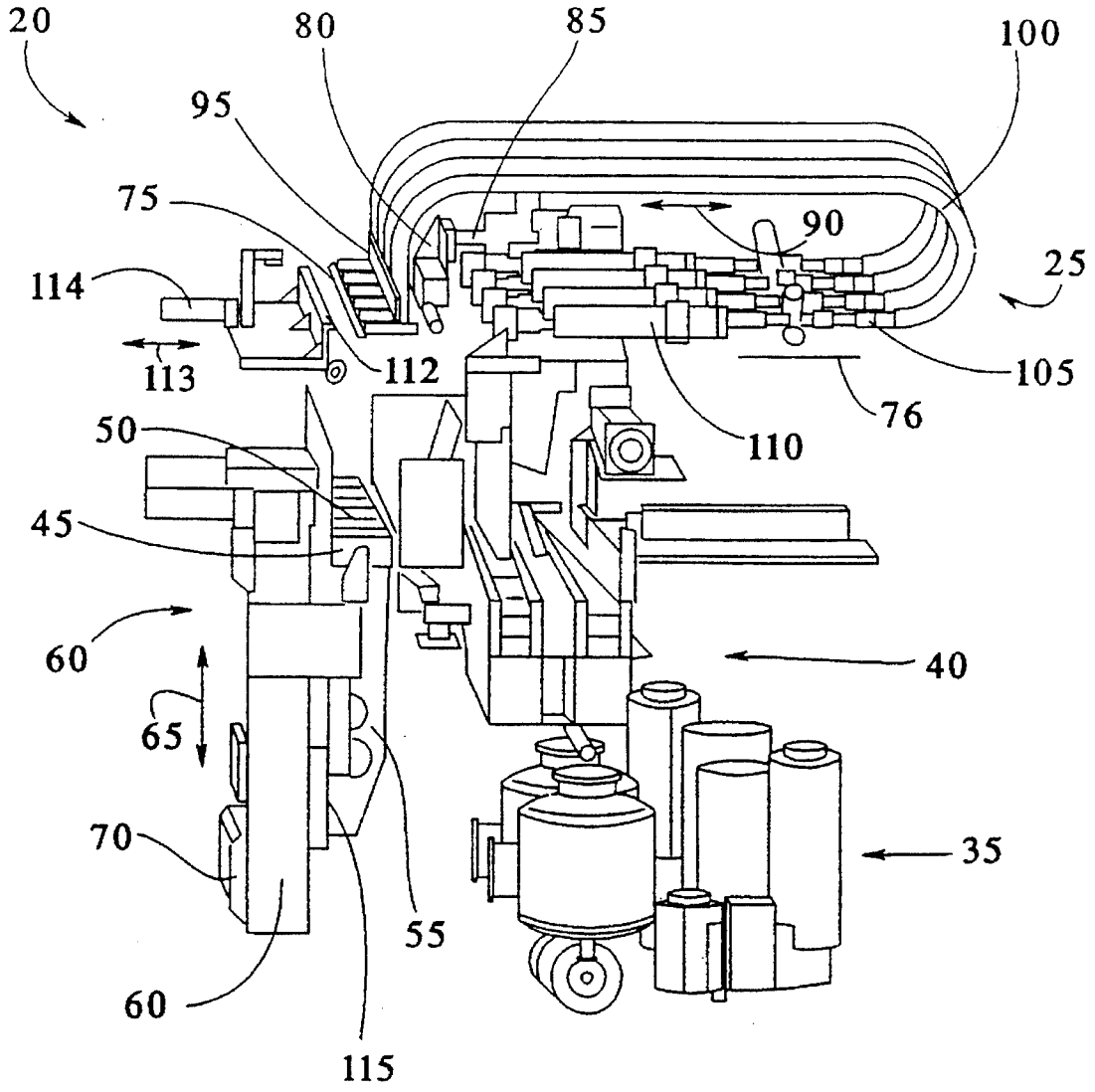
FIG. 1 is a perspective view of the vacuum bottom processing station.

A bottom forming processing station for heating and forming the bottom of a container is generally illustrated at 20 in FIG. 1. The bottom forming processing station 20 may be used for example, in a packaging machine such as the one disclosed in U.S. Ser. No. 08/190,546, filed Feb. 2, 1994, which is incorporated by reference. The bottom forming processing station 20 may be used, for example, to process cartons with a gable ended bottom such as those disclosed in U.S. Ser. No. 08/238,923, filed May 6, 1994, which is also hereby incorporated by reference. It should be appreciated, however, that the bottom forming processing station 20 is capable of adaptation to other packaging machines.

The bottom forming processing station 20 is generally comprised of a heating apparatus 25, a vacuum bottom former 30 that is operated, in part, by an underpressure source 35, and an outfeed mechanism 40. In operation, the underpressure source 35 is in fluid communication with the vacuum bottom former 30 via an underpressure hose which is not illustrated here for simplicity.

The vacuum bottom former 30 is located generally below the heating apparatus 25 and adjacent to the outfeed mechanism 40. The vacuum bottom forming apparatus 30 includes an array of cups 45. Each of the individual cups 50 of the array 45 has an opening generally corresponding to the bottom cross-section of a carton. The cup array 45 is secured to a beam 55 generally located below the cup array 45. The beam 55 is connected to a linear actuator 60, the linear actuator 60 being capable of moving the cup array 45 in the directions shown by arrows 65 under the action of a servo motor 70.

The heating apparatus 25 is generally located above the vacuum bottom former 30 and the out-feed mechanism 40. It includes an array of heating devices 76 that disperse hot air to heat the bottom gabled sections of the containers. The heater array 75 is connected to a plate 80 that, in turn is connected to air cylinder 85 which is capable of moving the heater array 75 in the directions indicated by arrow 90. The heater array 25 further includes a recirculation hood 95 and a plurality of recirculation hoses 100 connected in parallel with respective air inlets 105 and in series with respective heater housings 110. A support rail mechanism 112 is disposed proximate the heater array 75, the support rail 112 capable of moving in directions indicated by arrows 113, being driven by air cylinder 114.

The outfeed mechanism 40 is generally located below the heating apparatus 25 and adjacent to the vacuum bottom former 30. A suitable outfeed mechanism is disclosed in U.S. Ser. No. 08/315,409 (Attorney Docket No. 10594US01—Corporate Docket No. TRX—0113) filed on even date herewith, the disclosure of which is incorporated by reference. A further suitable outfeed mechanism is disclosed in U.S. Ser. No. 08/315,404 (Attorney Docket No. 10610US01—Corporate Docket No. TRX-0118) filed on even date herewith, the disclosure of which is incorporated by reference.

Figure 2:
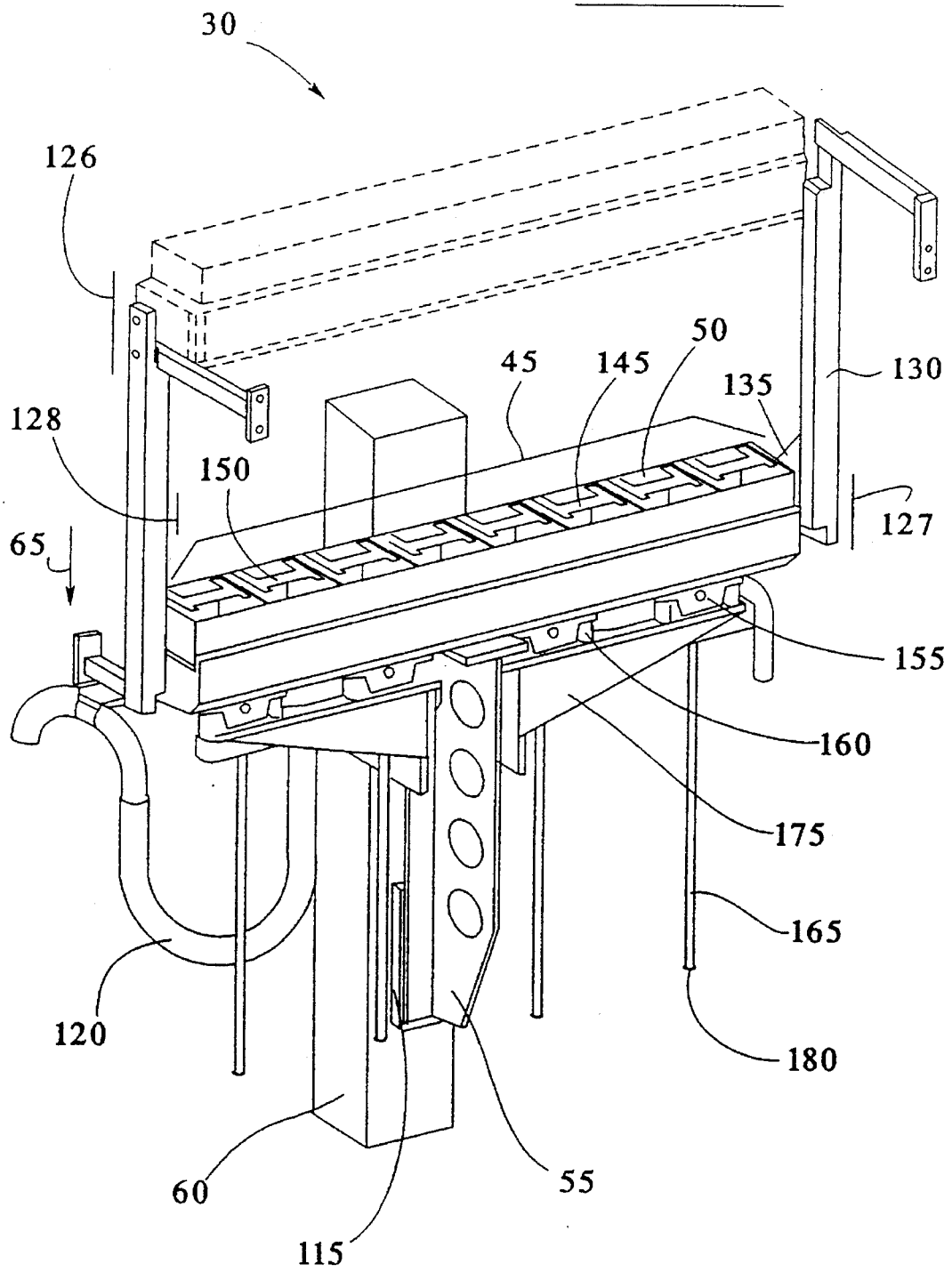
FIG. 2 is a perspective view of selected portions of the vacuum bottom former of FIG.

FIG. 2 illustrates selected components of the vacuum bottom former 30. As illustrated, the vacuum cup array 45 is connected to the vertically disposed beam 55 to form a generally T-shaped formation. The beam 55, in turn, is connected to a drive plate 115 that extends from, and is part of, the linear actuator 60. The linear actuator 60 may be, for example, driven by a servo motor (not shown in FIG. 2) to move the vacuum cup array 45 linearly in the directions indicated by arrow 65 from a first position 127, illustrated with true lines, to a second position 126, illustrated here in phantom outline. One example of a suitable linear actuator that can be used in the presently disclosed apparatus is a Model SS25 Linear Actuator manufactured by CAMCO.

Each vacuum cup 50 of the cup array 45 is in fluid communication with the underpressure source 35. This communication is facilitated in part by the interconnection of a vacuum hose 120 to an underpressure inlet 125 (shown in FIG. 6) generally disposed in the bottom of the cup array 45. The interconnection between the cup array 45 and the underpressure source 35 may be implemented in the manner illustrated in U.S. Ser. No. 08/315,405 (Attorney Docket No. 10617US01; Corporate Docket No. TRX-0123) entitled "Liquid Separating System for a Vacuum Operated Station of a Packaging Machine," filed concurrently herewith and hereby incorporated by reference. The cup array 45 moves along guide arms 130, disposed adjacent opposite ends of the cup array 45. Guide blocks 135 are secured to the opposite ends of the cup array 45 for guiding the array along the guide arms 130. When the cup array 45 moves in the illustrated manner the guide blocks 135 slide along the guide arms 130 thereby lending stability to the cup array 45 movement.

Figure 3:
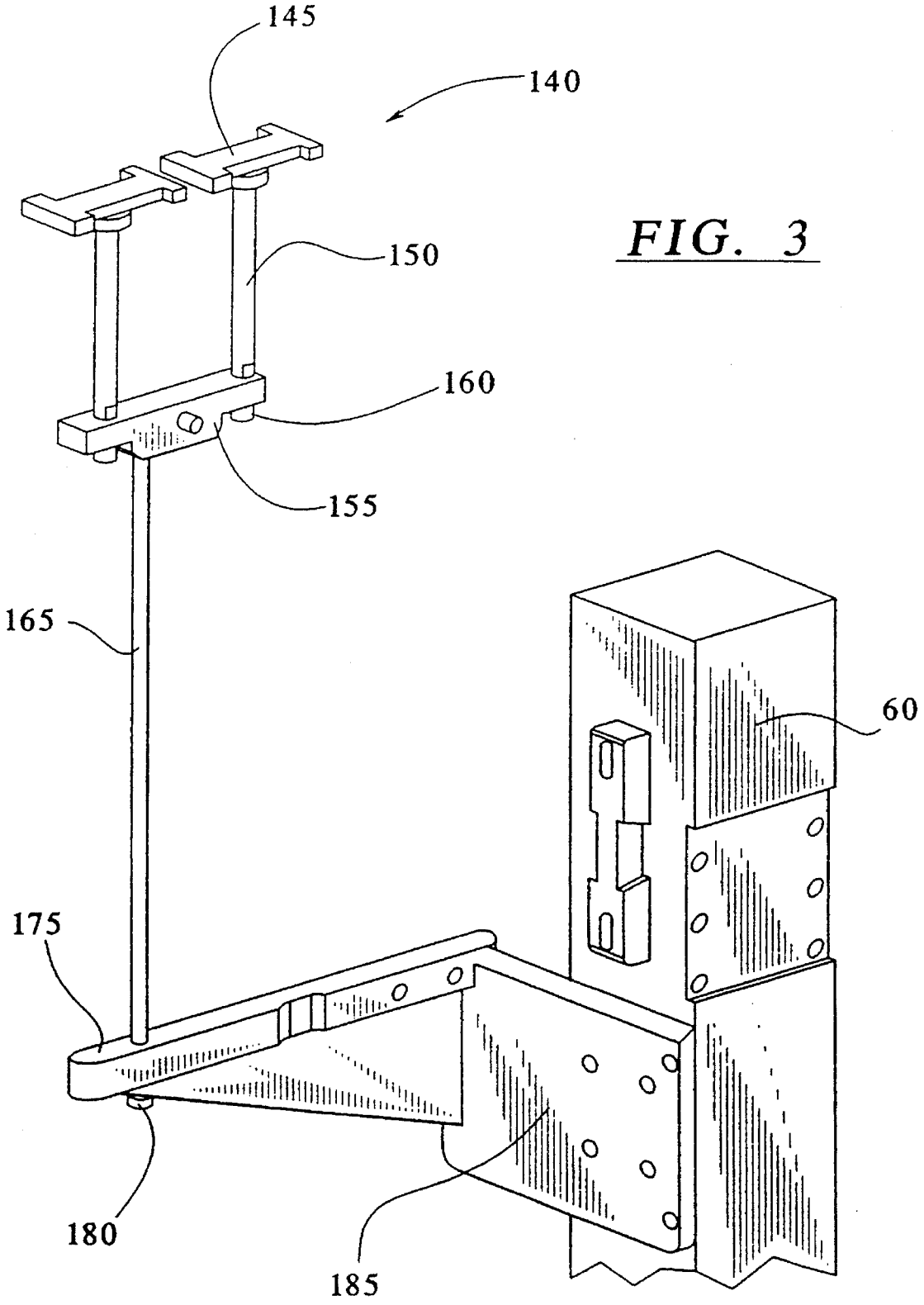
FIG. 3 is a perspective view of the ejecting mechanism shown in FIG. 2.

The vacuum bottom former 30 further includes a plurality of ejecting mechanisms 140, illustrated in context in FIG. 2 and in detail in FIG. 3, which eject the cartons after bottom forming. As illustrated, each ejecting mechanism 140 includes at least one anvil 145 disposed in a respective cup 50 that, in addition to functioning in ejection, facilitates forming of the gabled carton bottom into a generally flattened carton bottom. Each anvil 145 is connected to a respective piston 150 which is slidably disposed through an aperture at the bottom of the respective cup 50. Adjacent pistons 150 may be joined by a piston bracket 155 as illustrated in FIG. 3. The range of motion of the piston 150 within its respective cup 50 is restricted by the anvil 145 and the piston bracket 155.

The end of each piston 150 extends beyond the lower portion of the piston bracket 155 to form a bumper 160. The bumper 160 may alternatively be formed as a separate piece attached to the end of the piston 150. A guide rod 165 is attached at one end through an aperture disposed through the piston bracket 155 and extends generally downward from the piston bracket 155 to pass through a hole in a strike plate 175 at the other end. At the end of guide rod 165 distal the piston bracket 155 is a damper ring 180 that has a diameter that is sufficiently large enough to prevent the guide rod 165 from being pulled from the hole of the strike plate 175. The strike plate 175 is secured to a support arm 185, which, in turn, may be supported by connection with the housing of the linear actuator 60, as shown in FIG. 3. As illustrated in FIG. 2, strike plates 175 may be disposed on opposite sides of the linear actuator 60.

Figure 4:
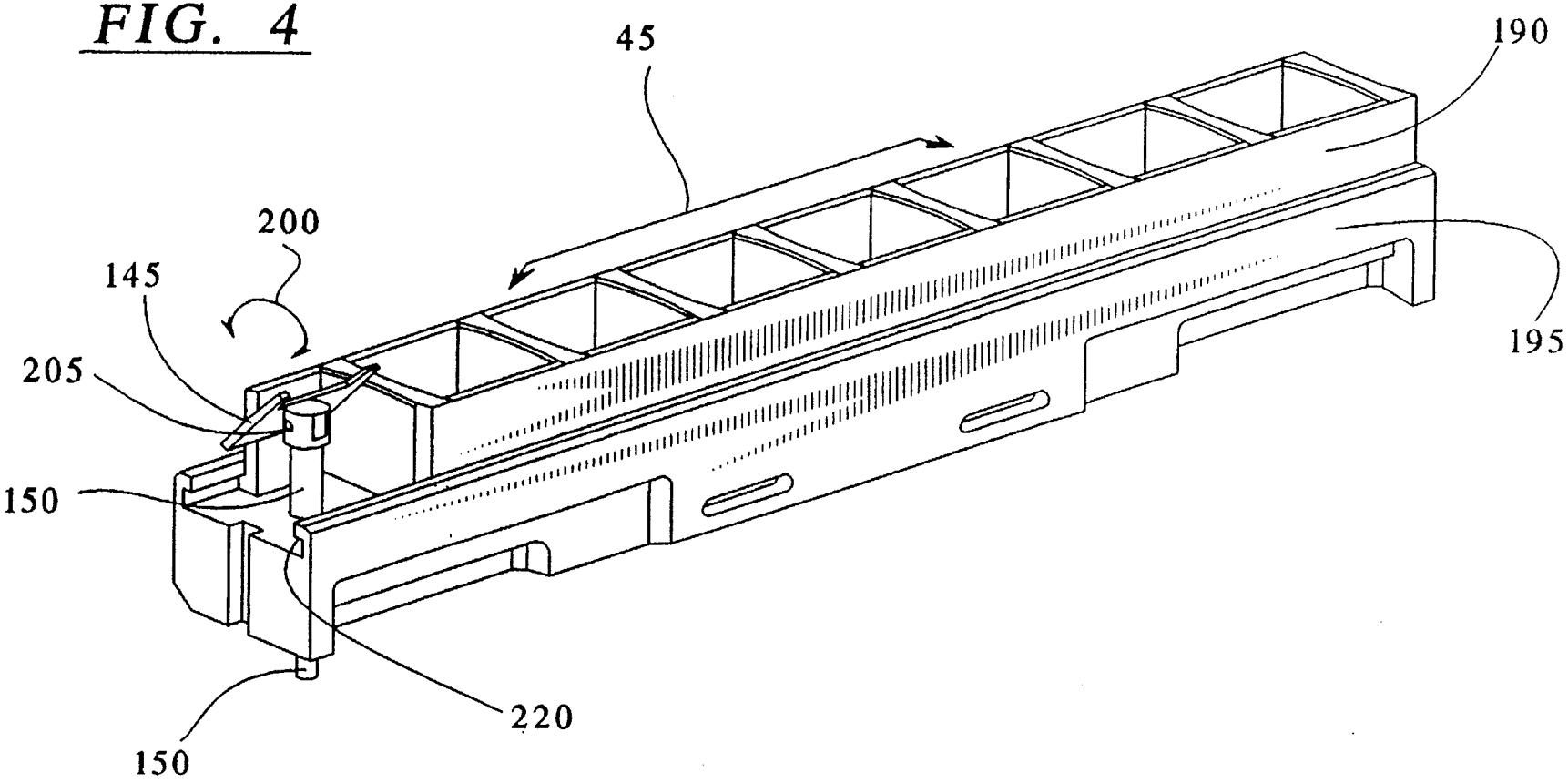
FIG. 4 is a detail view of the cup array shown in FIG. 2 with a section of one of the cups shown in cut away to reveal the anvil.

FIG. 4 illustrates one embodiment of the cup array 45. As illustrated, the cup array 45 may include an upper member 190 that is secured to a base member 195. A portion of one of the individual cups 50 is cut away to reveal the anvil 145 that, in the illustrated embodiment, is adapted for rotation in the direction of arrows 200, about a pivot 205. The anvil 145 may be disposed with respect to the pivot 205 to consistently pivot in the illustrated manner. Alternatively, the weight distribution of the anvil 145 with respect to the pivot axis 205 may be such that the anvil 145 consistently pivots toward the heavier side of the anvil forming tool 145 in the illustrated manner. The direction of normal pivot corresponds to the direction at which the fin of the gabled bottom carton is bent prior to engagement with the cup array 45. This allows the bottoms of the cartons to be formed in a consistent manner.

Figure 5:
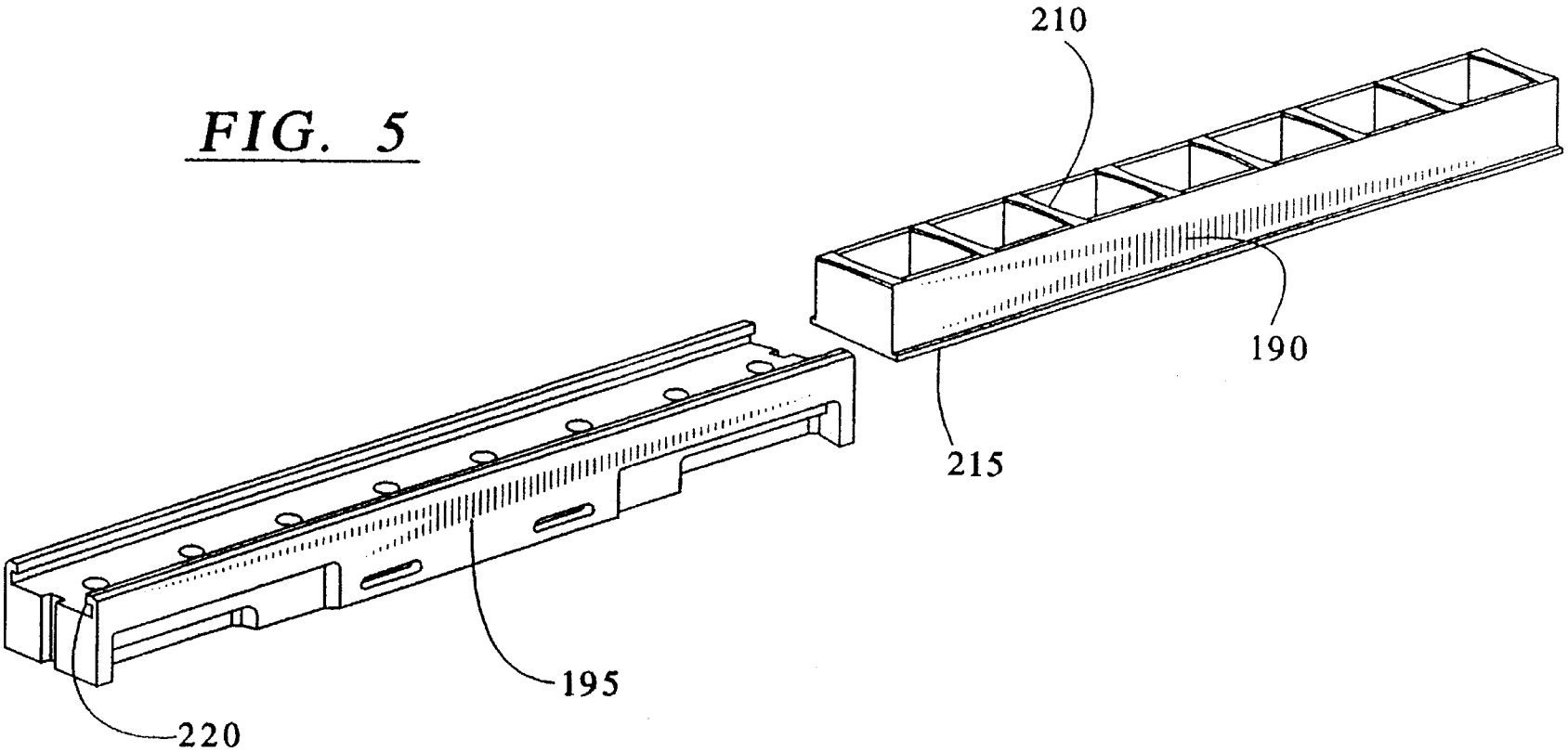
FIG. 5 is a further detail view of the cup array of FIG. 2 with the upper and lower members of the cup array disengaged.

FIG. 5 further illustrates selected attributes of the upper member 190 and base member 195 of the cup array 45. As illustrated, the upper member 190 includes cup sidewalls 210 that are dimensioned to engage a specific size carton while the base member 195 defines the bottom of the cups 50. The upper member 190 is provided with tongues 215 that are dimensioned to slidably engage corresponding grooves 220 in the base member 195. This allows the upper member 190 to be easily engaged and disengaged from the base member 195. In this manner, the upper member 190 can be easily replaced with a further upper member having differently dimensioned sidewalls thereby to facilitate modification of the packaging machine to accommodate different carton sizes.

Figure 6:
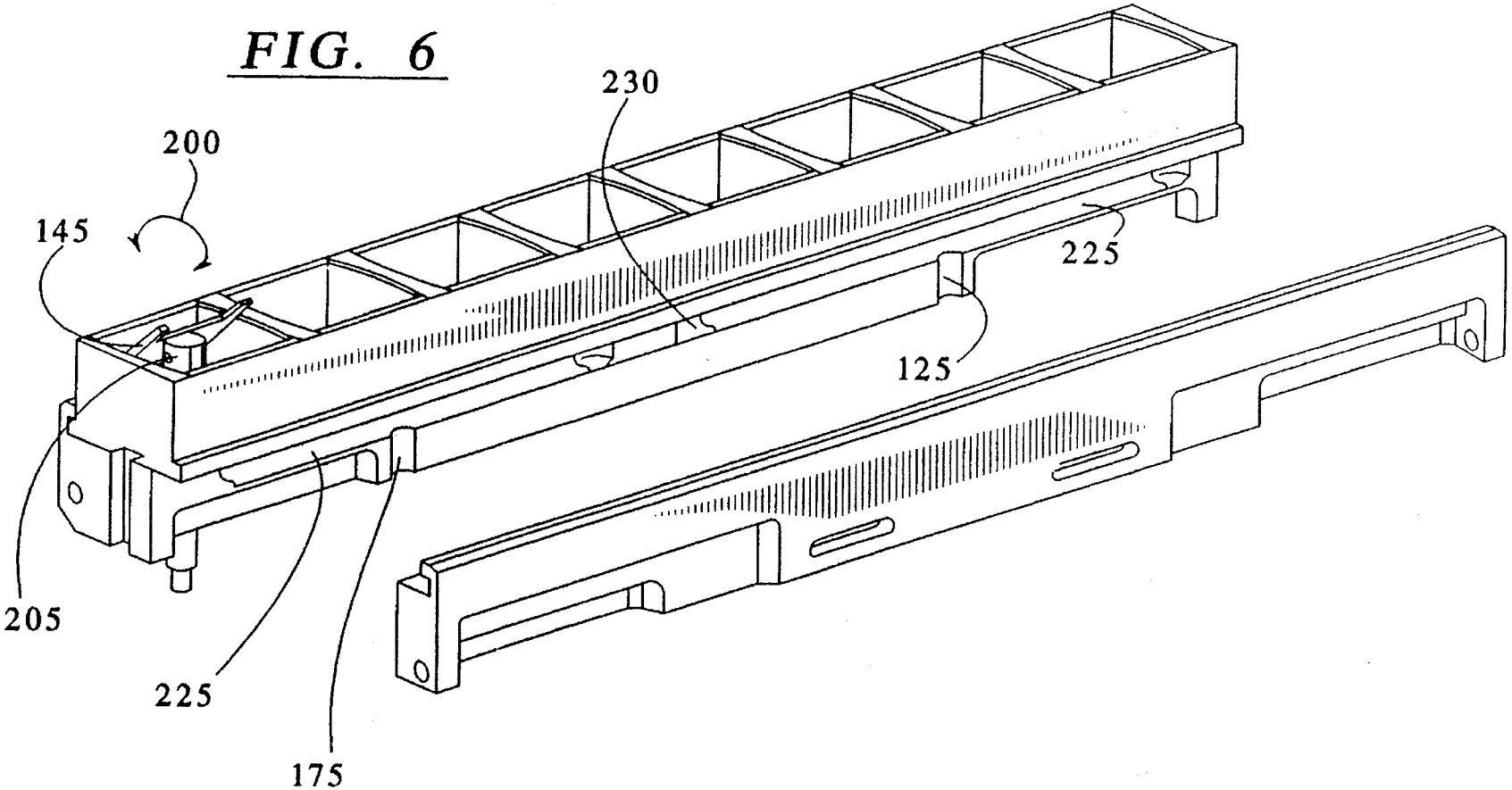
FIG. 6 is a detail view of the cup array of FIG. 2, the lower member being shown in longitudinal cross section.

FIG. 6 is a perspective view of the cup array 45 with the base piece 195 shown in longitudinal cross-section. In accordance with the illustrated embodiment, the base member 195 is provided with two inlets 125 each in fluid communication with a respective manifold 225. The manifolds 225 are divided from one another by a dividing wall 230. Each cup 50 of the array 45 is in fluid communication with a respective manifold 225 through a cup aperture 235 disposed through the base 195 (See FIG. 7). Underpressure source 35 is connected to the inlets 125 to generate an underpressure in each of the cups 50. As illustrated in FIG. 1, two underpressure sources may be utilized, each respectively associated with one of the inlets 125. Other methods of establishing fluid communication between the vacuum cups 50 and underpressure source 35 may likewise be employed.

Figure 7:
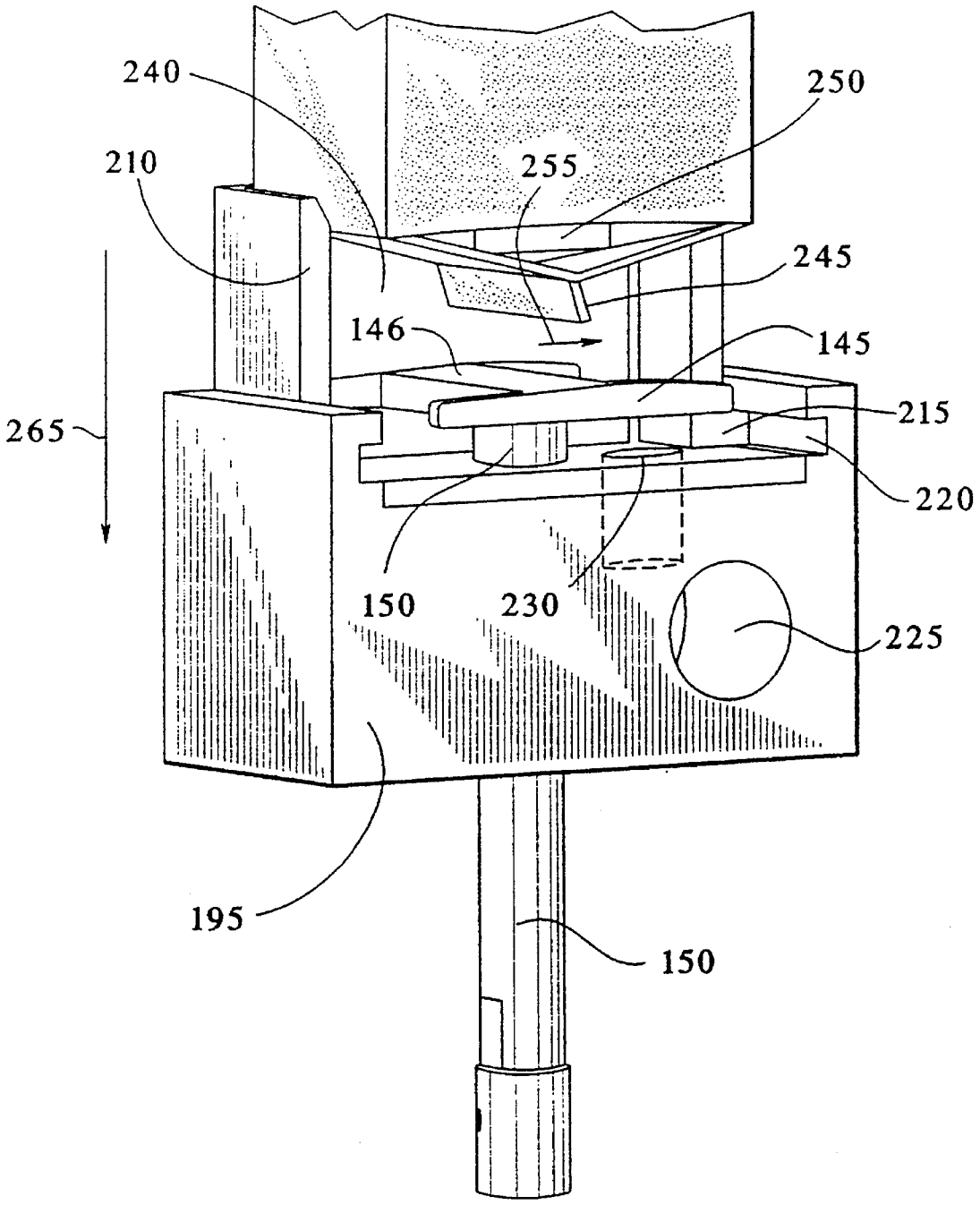
FIG. 7 is a cross-sectional view of one of the cups.

FIG. 7 is a cross-sectional view of one of the cups of the cup array 45. As illustrated, the shape of the sidewalls 210 and the base 195 define a vacuum cup recess 240 that substantially conforms with the shape and size of the bottom of the carton that is to be formed. The fin 245 of the gabled carton 250 is pre-bent in the direction of arrow 255 which is also the direction that the anvil 145 should naturally pivot (See FIG. 4) to ensure proper orientation between the anvil 145 and fin 245. When the vacuum bottom former 30 is used with a carton such as is disclosed in the aforementioned '923 application, the engagement surface 146 of the anvil 145 may be curved in a manner corresponding to the curve crease 252 of the gabled bottom.

In operation, the sidewalls 210 of the carton 250 form a seal with the sidewalls 210 of the cup thereby creating an underpressure within the cup that assists in driving the pre-heated bottom of the carton 250 downward in the direction of arrow 265 and into engagement of with the anvil 145. Engagement between the anvil 145 and pre-heated gabled bottom of the carton brings adjacent panels of the carton bottom together for sealing to form a folded bottom seat.

Figure 8A:
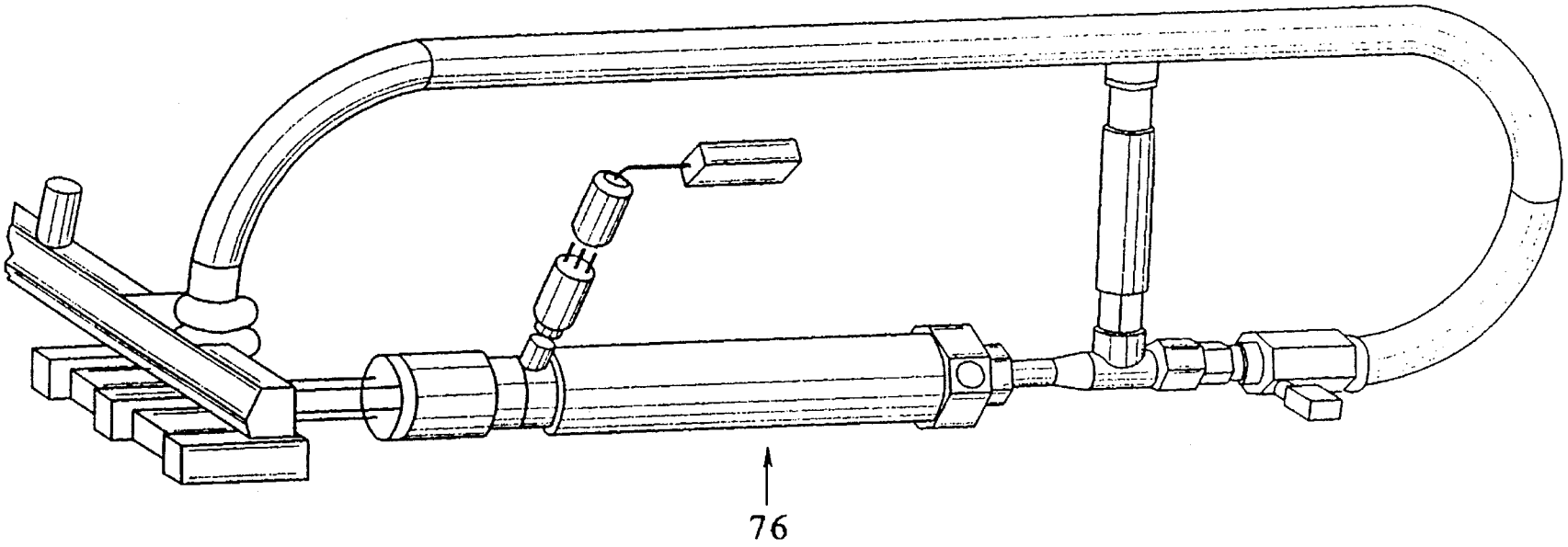
FIG. 8A is perspective view of an individual heating device of the heating apparatus shown in FIG. 2.

As noted above, the bottom of the cartons are pre-heated prior to engagement with the cup array 45. Such heating can be accomplished using the heater array 75 depicted in FIG. 1 which includes the plurality of heating devices 76. One such heating device is shown in FIG. 8A. The heating device may, for example, be constructed in accordance with the teachings of U.S. Pat. No. 5,155,799, which is hereby incorporated by reference.

Figure 8B:
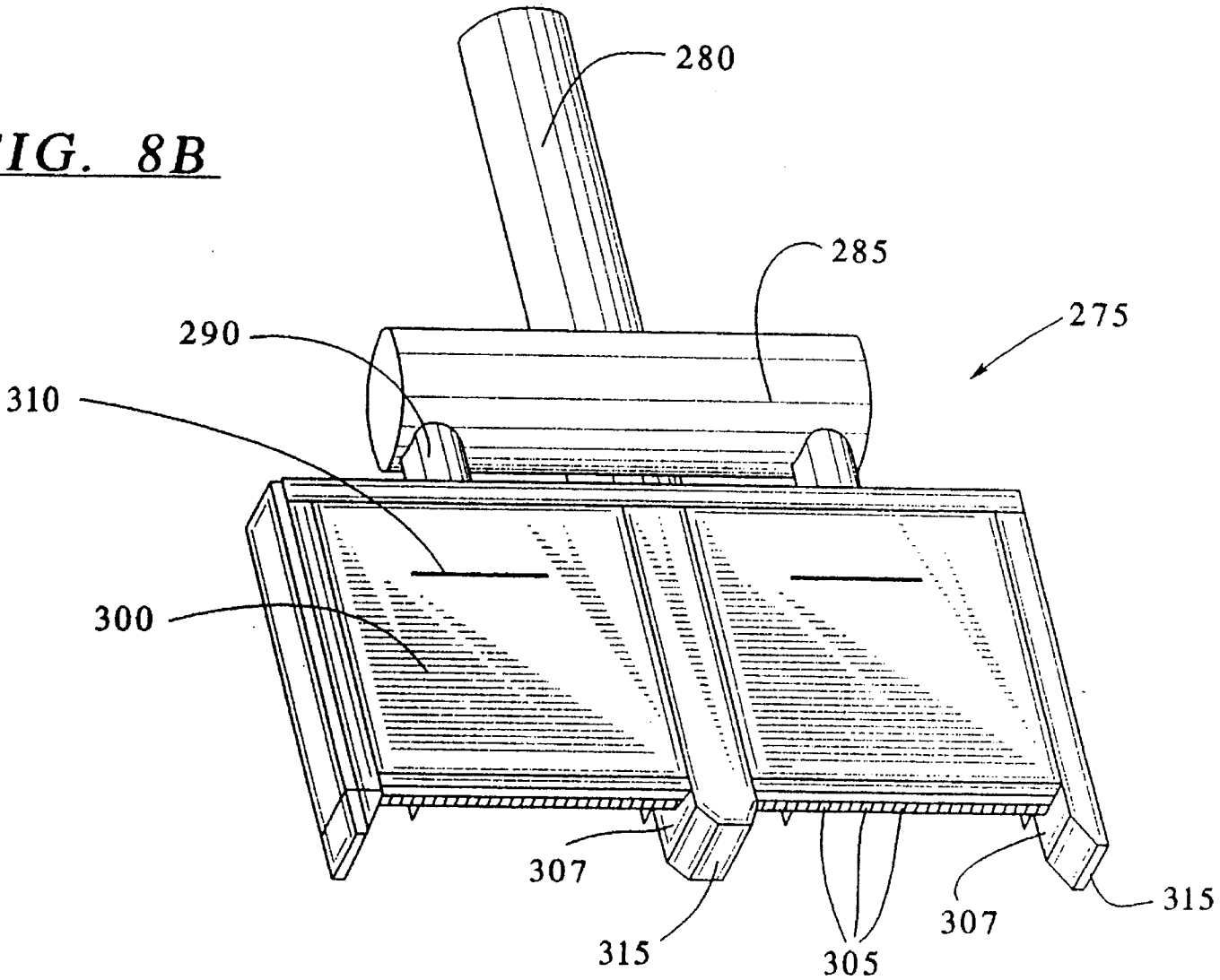
FIG. 8B is a perspective view of an individual heating nozzle of the heating apparatus shown in FIG. 1.

A nozzle unit 275 suitable for use in the heater array 75 is illustrated in FIG. 8B. The nozzle unit 275 includes an inlet channel 280 that receives air that has been heated in the heater housing 110. The inlet channel 280 opens to an expansion chamber 285 which is generally transverse to the inlet channel. The expansion chamber 285 opens to a pair of housing inlet channels 290 which, in turn open to a respective one of a pair of side by side nozzle housings 300, each having a plurality of apertures 305 disposed at a front portion thereof. A deflection plate 310 is disposed in each housing 300 in a direction transverse to the flow of heated air. The deflection plates 310 divide the flow of heated air to the apertures 305. Side arms 315 extend from the housings 300 and include a plurality of apertures 307 that are disposed to emit heated air in a direction transverse to the flow of air exiting apertures 305.

Figure 9:
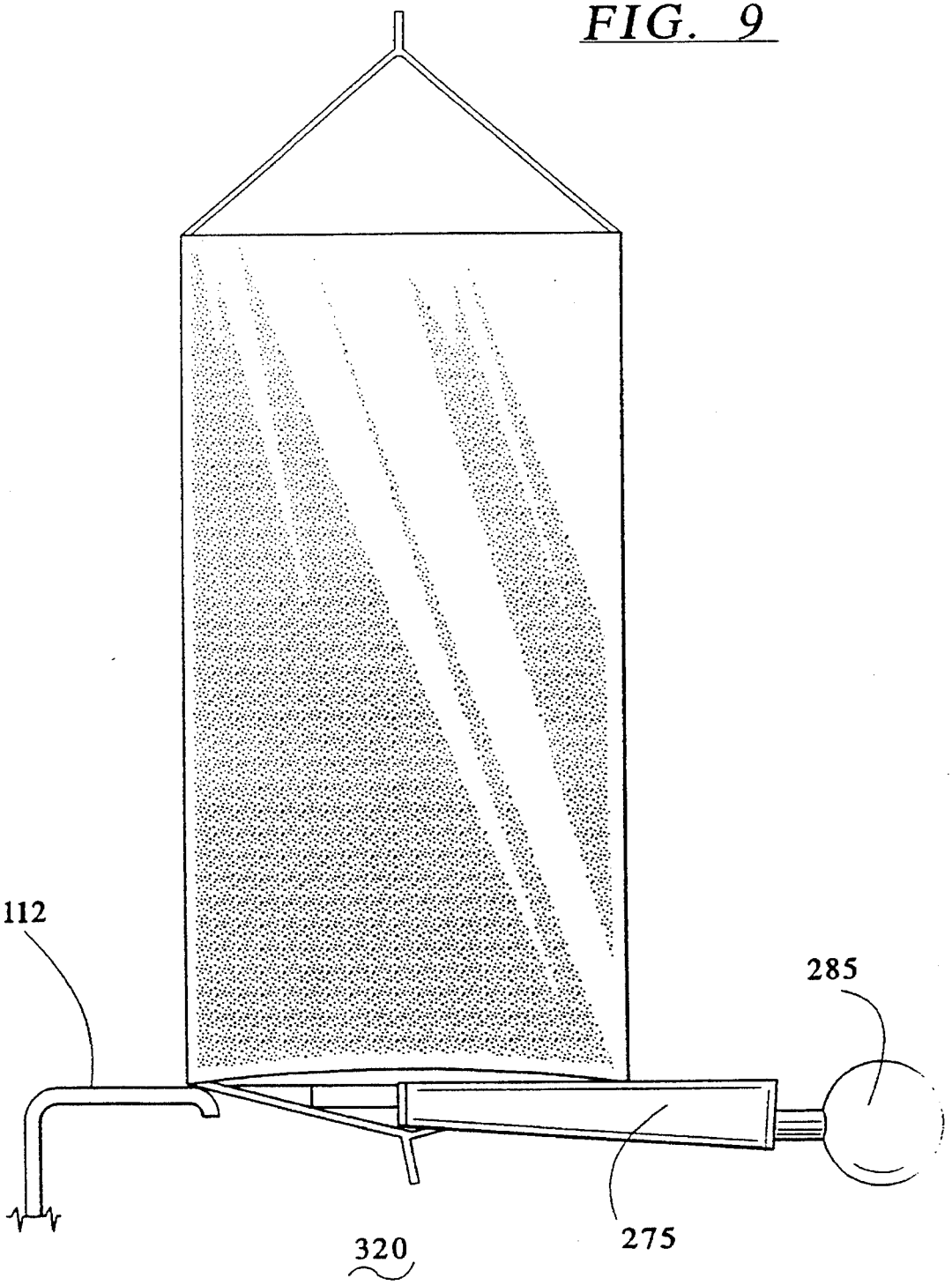
FIG. 9 is a perspective view of a carton in the heating position.

FIG. 9 shows a gable ended carton bottom in the heating position, generally indicated at 320. The nozzle 275 in the position depicted is capable of introducing heat to the fin and gable end of the carton bottom through the nozzle apertures 305 and 307. The apertures 307 located in the side arms 315 facilitate the heating of the gable recess 325.

Figure 10:
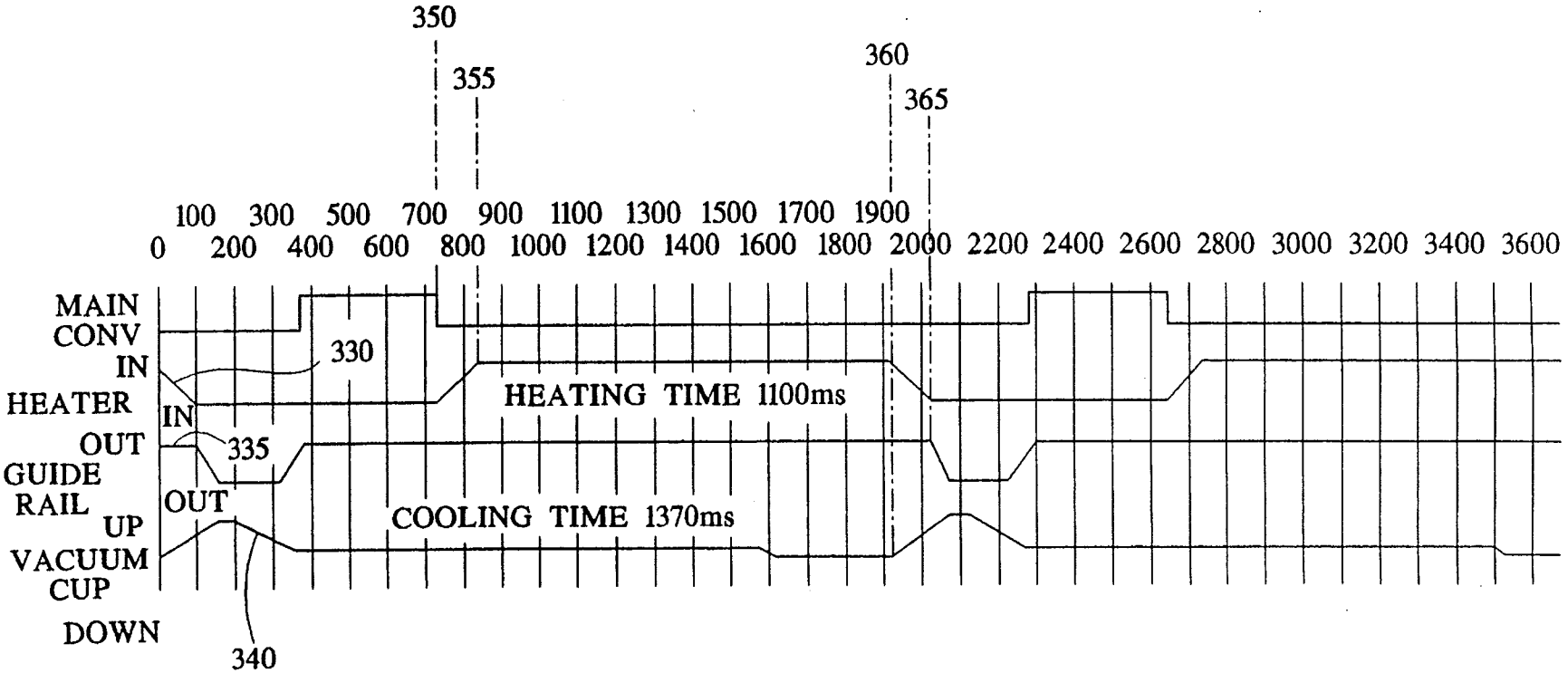
FIG. 10 is a general timing diagram illustrating operation of the processing station of FIG. 1.

FIG. 10 is a timing diagram indicating the position of certain elements of the heating apparatus 25 over time. The position of the heater array 75 is indicated by line 330. The position of the support rail 112 is indicated by line 335. The position of the cup array 45 is indicated by line 340.

The overall operation of the station 20 can be understood with reference to FIGS. 1, 9, and FIG. 10. As illustrated, the cartons are indexed to the heating position 320 along the support rail 112 by, for example, an endless belt conveyor of the type illustrated in the '526 application. Between time 350 and time 355 the air cylinder 85 moves the heater array 75 in the direction indicated by arrow 90 into the heating position 320. From time 355 to time 360 the gabled ends of the cartons are heated by air flowing from the nozzles 275 of the heater array 75. The heater array is then withdrawn in the direction indicated by arrow 90 from the heating position 320 by air cylinder 85 between times 360 and 365. As the heater array 75 is withdrawn, the support rail 112 is retracted by air cylinder 114 removing all vertical support from the cartons. By the time that the support from the cartons has been removed, the cup array 45 has been driven by the linear actuator 60 to the second position 126 (See FIG. 2) proximate the support rail 112. The damper rings 180 prevent the guide rods 165 from disengaging from the corresponding apertures in the strike plates 185 and, further, assist in ensuring that the anvil 145 is moved to its lowest position. As the support rail 112 is retracted, the heated cartons engage respective vacuum cups 50 in the manner described above. After the carton bottoms are securely within the respective vacuum cups 50, the cup array 45 moves to a mid-level position, disposed between to allow additional cartons to index into the heating position 320. The mid-level position is low enough to allow cartons to pass along the support rail 112 above, yet not low enough to cause the ejecting mechanisms 140 to eject the cartons from the cups 50.

After sufficient time has passed for the thermoplastic layer to cool, the cup array 45 is driven from the mid-level position to the first position 127 (see FIG. 2). As it moves, the bumper portions 160 of the pistons 150 impact the strike plate 175 (shown in FIG. 2) which drives the pistons 150 and the respective anvils 145 in an upward direction to eject the cartons from the cups 50 of the cup array 45. The carton is then is in a position to be accepted by the outfeed apparatus 40.

Figure 11:
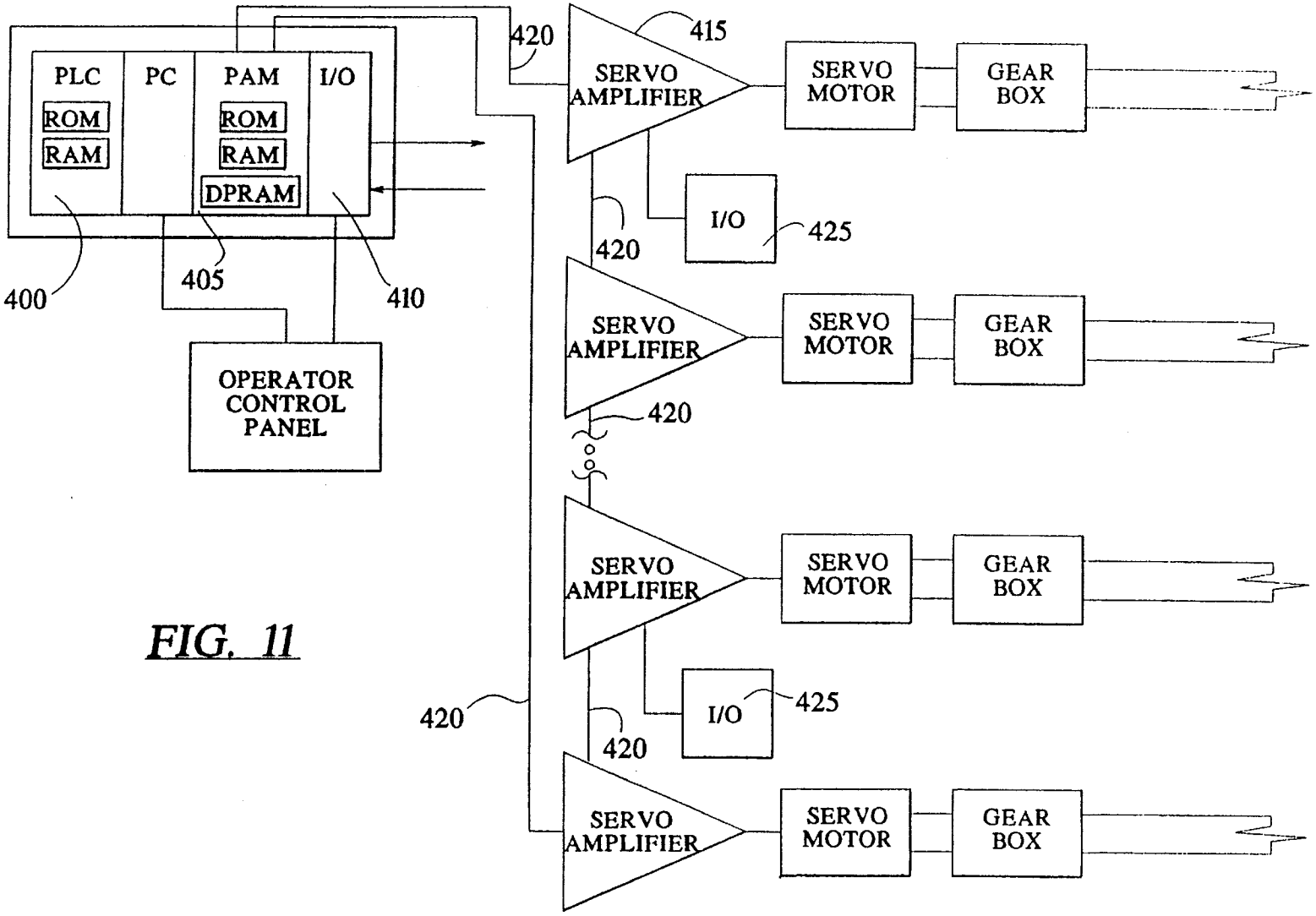
FIG. 11 is a schematic block diagram of a control system suitable for control of the vacuum bottom forming station.

FIG. 11 is a schematic block diagram illustrating one embodiment of a control system suitable for controlling the vacuum bottom former 30 as well as other components of the packaging machine. The control system includes a programmable logic controller ("PLC") 400, an example of which is the GE Fanuc model 9070 and a programmable axis manager ("PAM") 405, an acceptable model, for example, being manufactured by Socapel. The PAM and PLC communicate with one another over a common bus, for example, in the manner disclosed in U.S. Ser. No. 08/305,414 (Attorney Docket No. 10623US01; TRX-0126), entitled "Control System for a Packaging Machine, filed on even date herewith and incorporated by reference. The PLC interfaces with various input and output devices of the packaging machine via an I/O interface card 410 such as one suitable for use with previously noted GE/Fanuc model. The PAM 405 interfaces with a plurality of servo amplifiers 415 along a ring network designated at lines 420. An example of a suitable servo amplifier 415 is the model ST1 by Socapel. Actuation of the linear drives that drive the heater array 75 and support rail 112 may be controlled via an I/O interface card 425 associated with the servo amplifier 415 or by the I/O interface 410 of the PLC 400.

Figure 12:
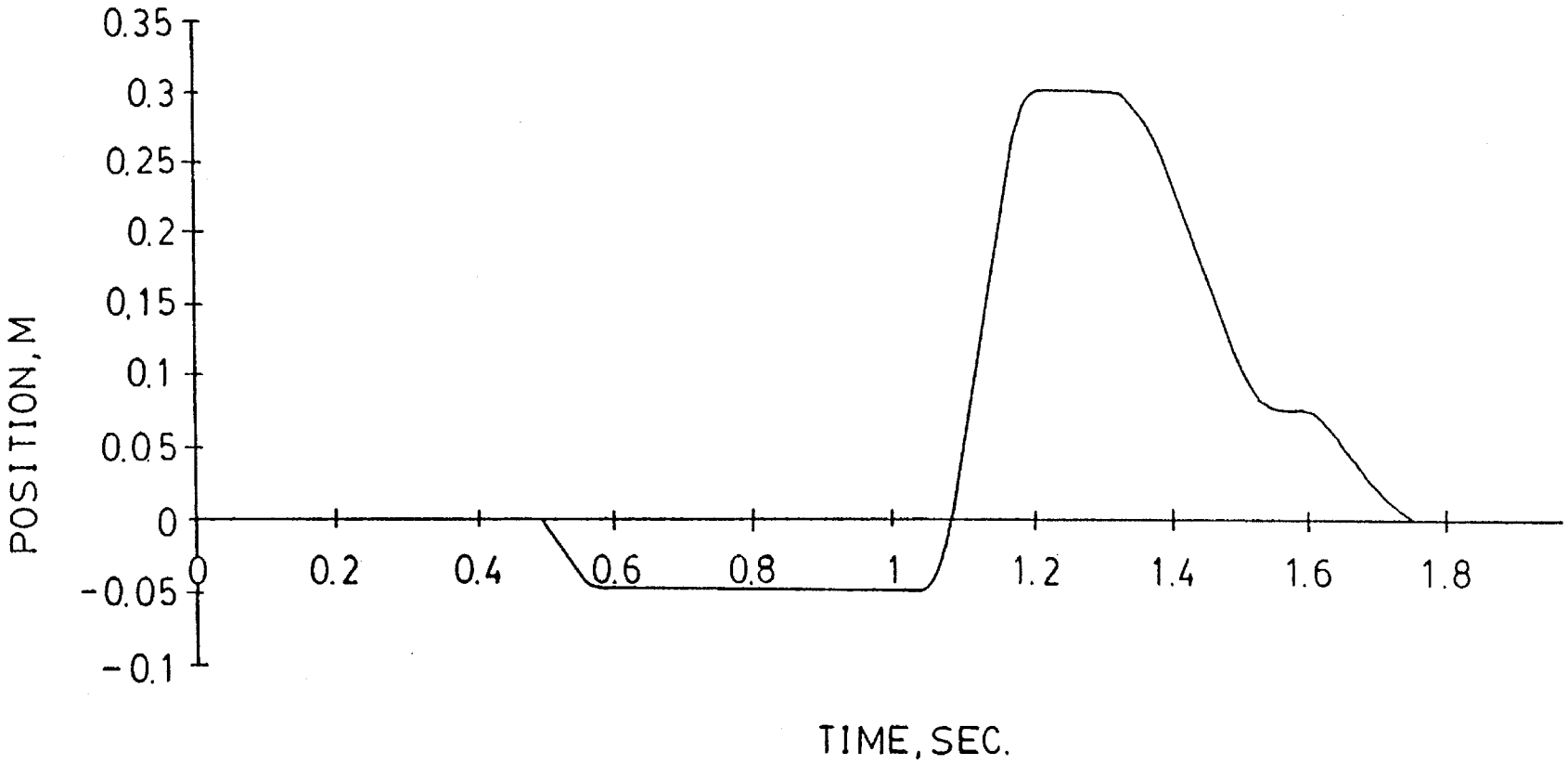
FIG. 12 illustrates an exemplary position profile for movement of the cup array of FIG. 2.
Figure 13:
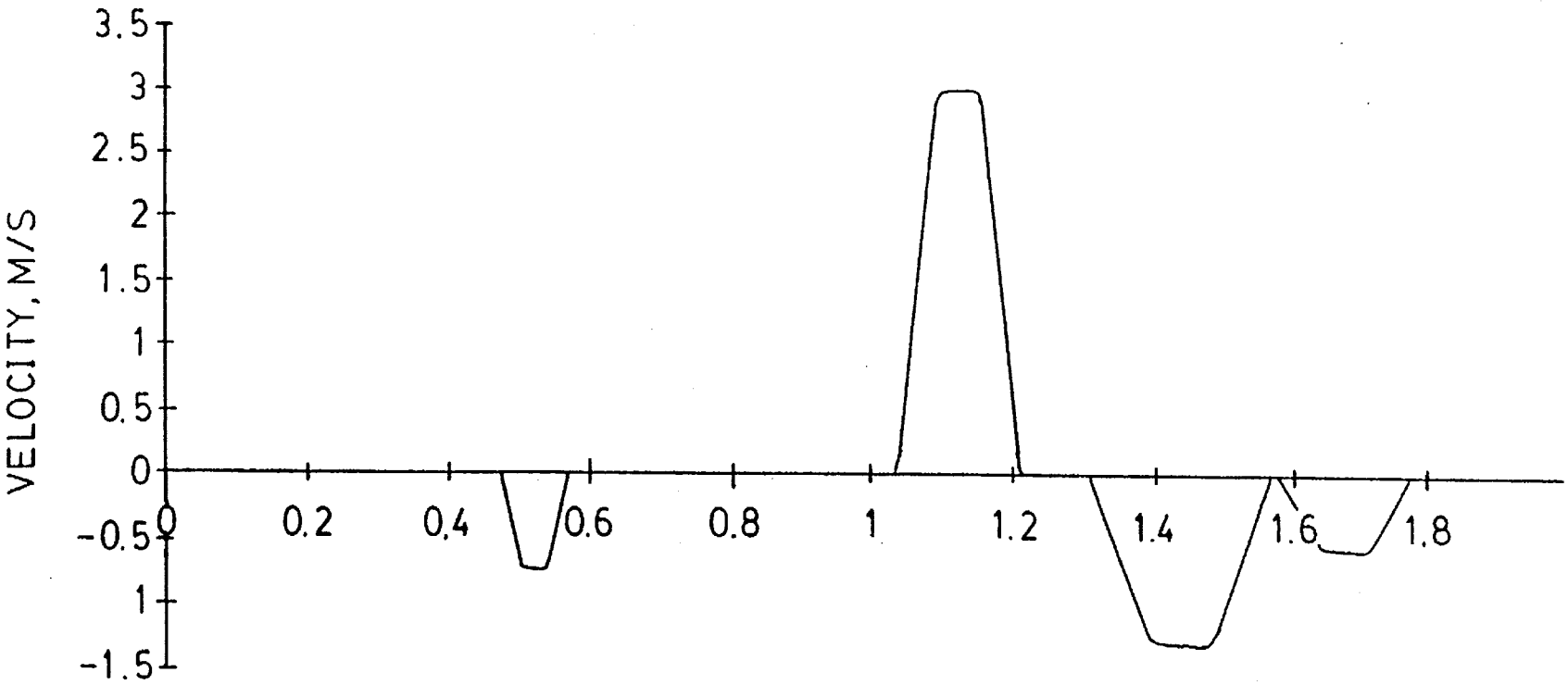
FIG. 13 illustrates an exemplary velocity profile for movement of the cup array of FIG. 2.
Figure 14:
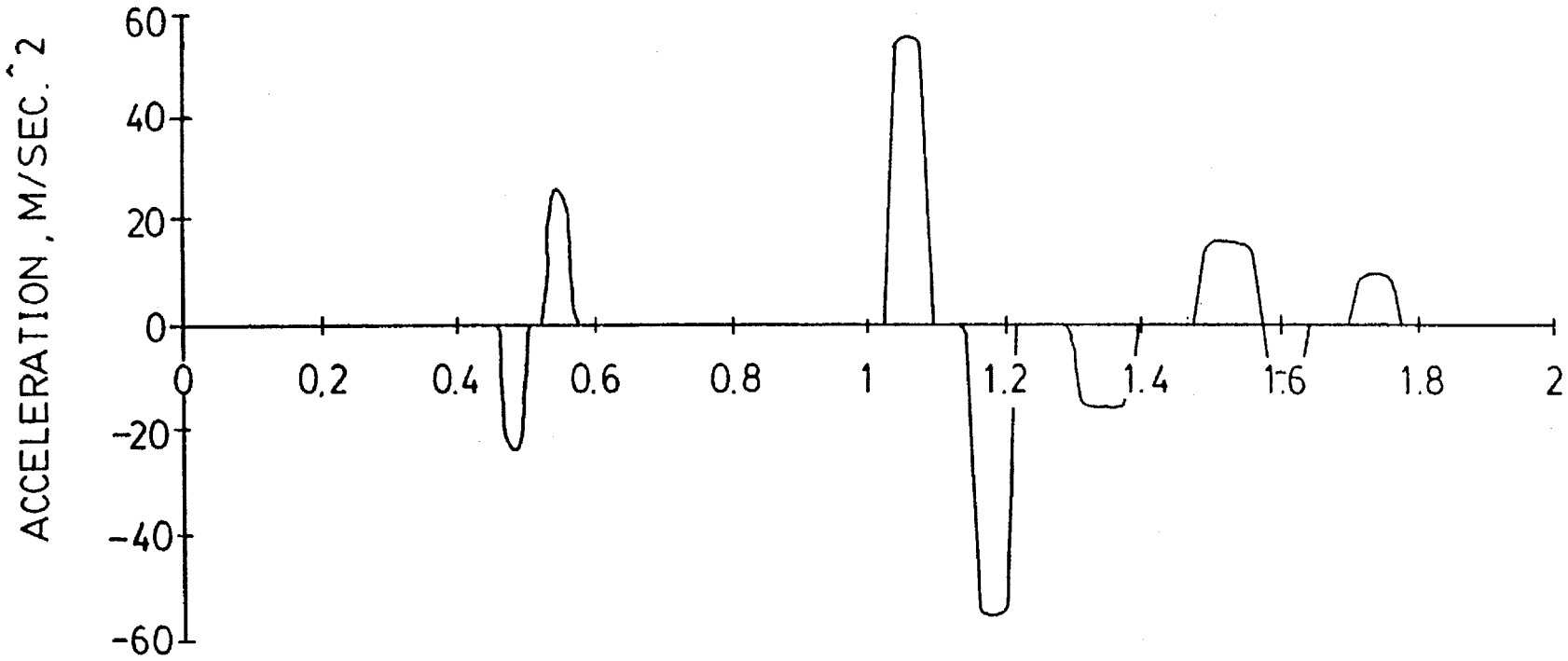
FIG. 14 illustrates an exemplary acceleration profile for movement of the cup array of FIG. 2.

Servo amplifier 415 is connected to control the motion of the linear actuator 60 of the vacuum bottom former 30. An exemplary motion profile that may be executed by the PAM 405, servo amplifier 415 and servo motor 70 is illustrated in FIGS. 12–13–14 which illustrate the position profile, velocity profile, and acceleration profile respectively.

The illustrated profile begins with cartons already in the cups of the array 45. At this point the cups can move down whereas the cartons can not move down any further. The first motor move drives the cup array 45 down from around the carton bottoms a sufficient distance to assure that the top edges of the cups can not "trip" the cartons when they are pushed horizontally out of the station. The cups have to remain at that level long enough for the pusher of the outfeed mechanism to shove the cartons out and then retract back out of the upward path of the cups.

The second move of the profile begins as soon as the pushers are clear of the upward path of the cup array 45. The second move drives the cup array 45 up as fast as the current and voltage that, for example, the ST1 amplifier can allow. Within the accelerations (or decelerations) of this move 20% of the time is spent ramping up to constant acceleration and 20% of the time is spent ramping down to zero acceleration. The ramping of accelerations was done to limit jerking of the driven mechanisms.

After the linear actuator 60 has finished driving the cup array 45 to its top position, the cup array 45 must dwell there long enough to allow the vacuum to drive the carton bottoms firmly into the cups 50 against the anvil 145. A mechanism may be added to push the cartons down into the cups in an effort to shorten the time it takes to get the folded carton bottoms firmly against the cup bottoms for better sealing of the bottom folds and to better assure that the cartons stay in the cups during the move down.

Figure 15:
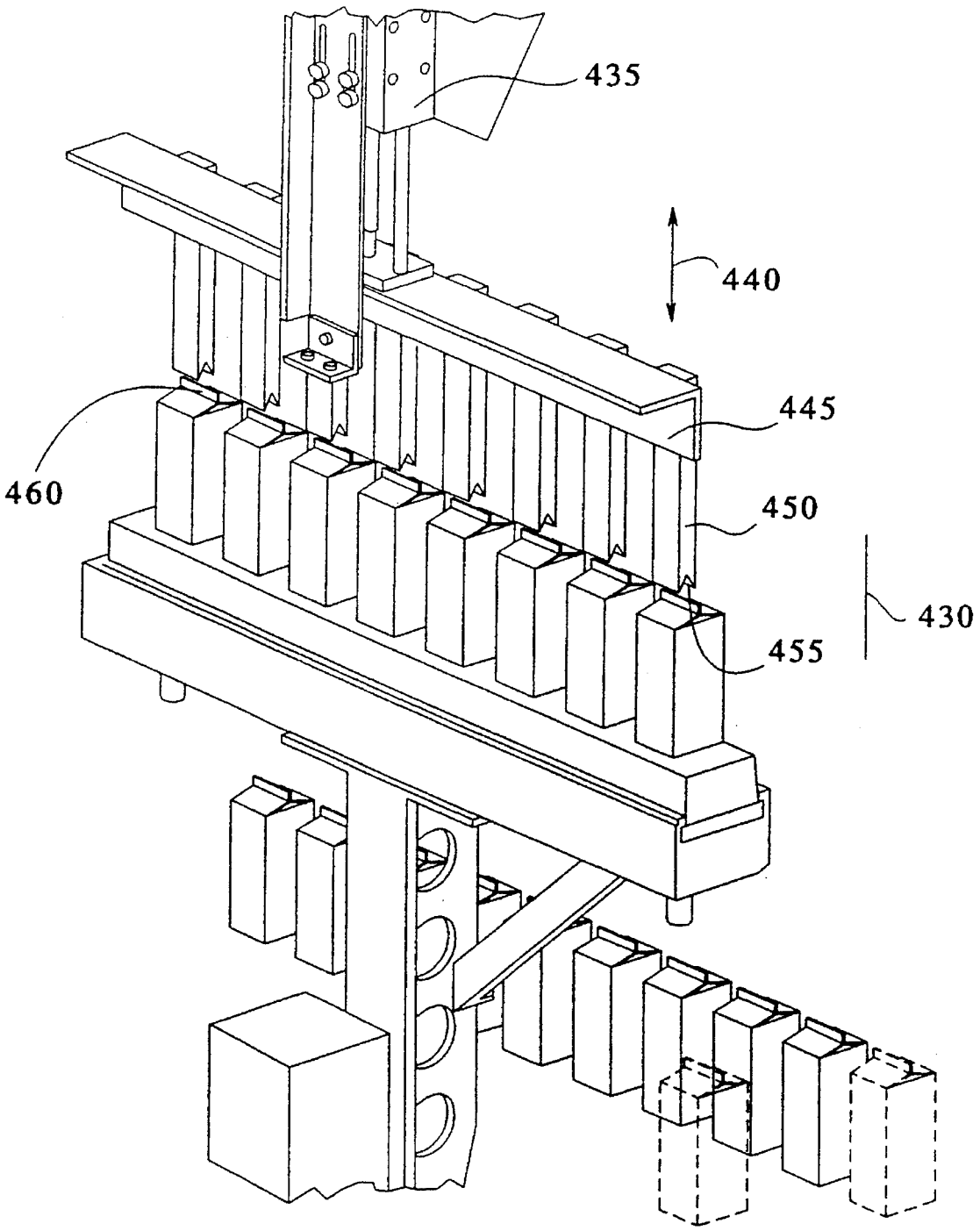
FIG. 15 is a perspective view of a pusher mechanism that may be used to assist in driving the cartons into the cup array.

FIG. 15 illustrates one pusher mechanism 430 suitable for pushing the cartons down into the cups. The pusher mechanism 430 is generally located above the cartons when they are in the heating position 320. The pusher mechanism 430 comprises an air cylinder 435 capable of moving the pusher mechanism 430 in the directions indicated by arrow 440. The pusher mechanism 430 further comprises a push plate 445, with individual push bars 450 attached to the push plate 445 and extending generally downward therefrom. The end 455 of each push bar 450 is shaped to conform to the top gable of a carton. In operation, the air cylinder 435 drives the push plate 445 down at the time that vertical support is removed from the heated cartons. The notch 455 engages the upper carton fin 460, forcing the cartons down into the waiting cup array 45.

After the dwell, the third move takes the cup array down as quickly as is necessary to reach the mid-level position. The smallest accelerations that enable the avoidance of collisions are desirable, first, to prevent the cups from leaving the cartons behind and, second, to keep the bottom folds of the carton as tight against the cup bottoms as possible.

The fourth move does not have to cope with any abnormal demands. The fourth move is thus a leisurely drop down to the home position.

Figure 16:
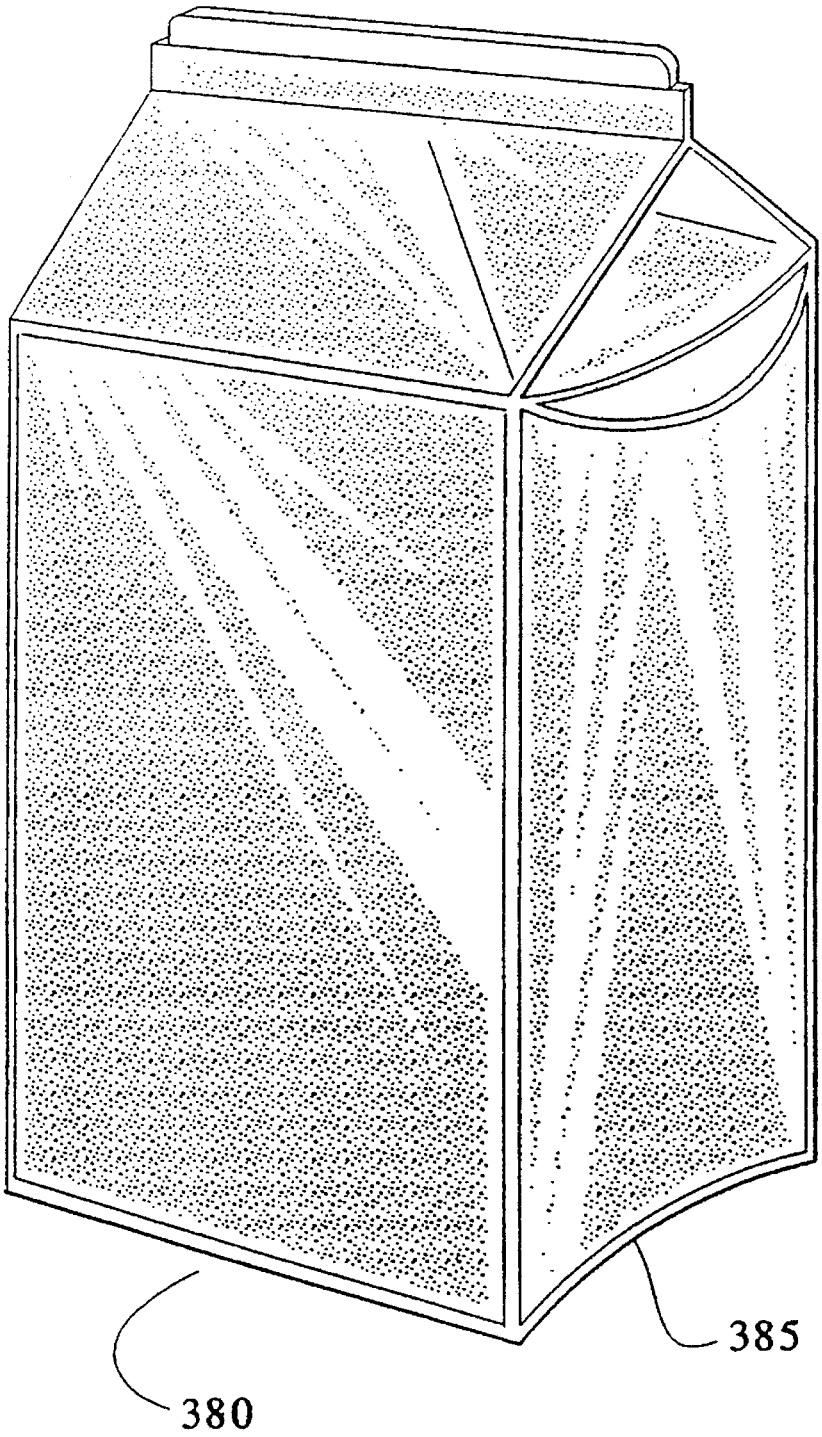
FIG. 16 is a perspective view of a carton with a formed bottom.

FIG. 16 illustrates a carton that has had its bottom formed by the vacuum bottom former 30. As illustrated, the formerly gabled bottom has now been folded to form a generally flat seating area 380 that, for example, may include curved side creases 385.

Although the present invention has been described with reference to a specific embodiment, those of skill in the art will recognize that changes may be made thereto without departing from the scope and spirit of the invention as set forth in the appended claims.

We claim:

1. An apparatus for forming a generally flattened seating area from a gabled bottom of a carton, the gabled bottom having an extending fin, the apparatus comprising:

an underpressure source;

a cup having a recess for receiving a carton having a gabled bottom structure and a carton cross-section, the recess having a shape generally corresponding to the carton cross-section, the cup further including an inlet in fluid communication with the recess and the underpressure source;

an anvil disposed in the recess, the carton/forming a seal with the cup to create an underpressure in the recess that assists in driving the gabled bottom of the carton into engagement with the anvil thereby to form the gabled bottom structure including the extending fin into a generally flattened seating area.

2. An apparatus as claimed in claim 1 wherein the gabled bottom of the carton and the anvil are driven into engagement as a result of an underpressure in the recess that is generated by the underpressure source and by gravity.

3. An apparatus as claimed in claim 1 wherein the anvil is connected to an ejecting means for ejecting the carton from the recess after the generally flattened seating area has been formed.

4. An apparatus as claimed in claim 3 wherein the ejecting means comprises a piston connected to the anvil, the piston slidably disposed through an aperture in the cup.

5. An apparatus as claimed in claim 4 wherein the ejecting means further comprises a linear actuator connected to drive the piston into the cup.

6. An apparatus as claimed in claim 1 and further comprising heating means for pre-heating the gabled bottom of the carton prior to engagement between the gabled bottom of the carton and the anvil thereby to facilitate heat sealing of the generally flattened seating area.

7. An apparatus as claimed in claim 6 wherein the heating means is disposed above the cup, the apparatus further comprising drive means for moving the cup between a first position distal the heating means and a second position proximate the heating means.

8. An apparatus as claimed in claim 3 wherein the ejecting means comprises:

a piston connected to the anvil and slidably disposed through an aperture in the cup, the piston extending from the cup to form a bumper;

a strike plate disposed below bumper;

drive means for creating relative movement between the strike plate and bumper, relative movement between the strike plate and the bumper causing the piston to drive upward into the cup to eject the carton.

9. An apparatus as claimed in claim 8 wherein the drive means is a linear actuator that moves the cup from a first position at which the bumper is distal the strike plate to a second position at which the bumper engages the strike plate.

10. An apparatus as claimed in claim 1 wherein the cup comprises:

a base member; and an removable upper member, the removable upper member being interchangeable to accommodate different size cartons.

11. An apparatus for forming a generally flattened seating area from a gabled bottom of a carton in a plurality of cartons, each gabled bottom of the plurality of cartons having an extending fin, the apparatus comprising:

an underpressure source;

a cup array having a plurality of cups, each of the cups having a recess for receiving a respective carton having a gabled bottom structure and a carton cross-section, the recess having a shape generally corresponding to the carton cross-section, the cup further including an inlet in fluid communication with the recess and the underpressure source;

a plurality of anvils, each anvil respectively disposed in the recess of a respective cup of the cup array, the respective carton forming a seal with the cup to create an underpressure in the recess that assists in driving the gabled bottom of the respective carton into engagement with the anvil thereby to form the gabled bottom structure including the fin into a generally flattened seating area.

12. An apparatus as claimed in claim 11 wherein the gabled bottom of the respective carton and the anvil are driven into engagement as a result of an underpressure in the respective recess that is generated by the underpressure source and by gravity.

13. An apparatus as claimed in claim 11 wherein the plurality of anvils are connected to an ejecting means for ejecting the cartons from the recesses after the generally flattened seating areas have been formed.

14. An apparatus as claimed in claim 13 wherein the ejecting means comprises a plurality of pistons, each of the plurality of pistons being connected to a respective one of the plurality of anvils, each of the pistons being slidably disposed through an aperture in the respective cup.

15. An apparatus as claimed in claim 14 wherein the ejecting means further comprises a linear actuator connected to drive the pistons into the cups.

16. An apparatus as claimed in claim 11 and further comprising heating means for preheating the gabled bottoms of the cartons prior to engagement between the gabled bottoms of the cartons and the anvils thereby to facilitate heat sealing of the generally flattened seating areas.

17. An apparatus as claimed in claim 16 wherein the heating means is disposed above the cup array, the apparatus further comprising drive means for moving the cup array between a first position distal the heating means and a second position proximate the heating means.

18. An apparatus as claimed in claim 13 wherein the ejecting means comprises:

a plurality of pistons, each of the plurality of pistons being connected to a respective one of the plurality of anvils, each of the pistons being slidably disposed through an aperture in the respective cup; each of the plurality of pistons extending from the respective cup to form a bumper;

a strike plate disposed below the bumpers;

drive means for creating relative movement between the strike plate and the bumpers, relative movement between the strike plate and the bumpers causing the pistons to drive upward into the cups to eject the cartons.

19. An apparatus as claimed in claim 18 and further comprising:

a piston bracket connecting at least two adjacent pistons;

a guide rod connected to the piston bracket at a first end thereof and extending through an aperture in the strike plate at a second end thereof for sliding engagement between the strike plate and guide rod, the second end of the guide rod having a stop member to prevent the guide rod from being disengaging from the aperture.

20. An apparatus as claimed in claim 18 wherein the drive means is a linear actuator that moves the cup array from a first position at which the bumper is distal the strike plate to a second position at which the bumper engages the strike plate.

21. An apparatus as claimed in claim 19 wherein the drive means is a linear actuator that moves the cup array from a first position at which the bumper is distal the strike plate to a second position at which the bumper engages the strike plate.

22. An apparatus as claimed in claim 11 wherein the cup array comprises:

a base member forming the bottom of the cups of the cup array; and a removable upper member forming the sidewalls of the cups of the cup array, the removable upper member being interchangeable to accommodate different size cartons.

23. An apparatus for forming a generally flattened seating area from a gabled bottom of a carton, the apparatus comprising:

an underpressure source;

a cup having a recess for receiving a carton, the recess having a shape generally corresponding to the carton, the cup further including an inlet in fluid communication with the recess and the underpressure source;

an anvil disposed in the recess, the carton forming a seal with the cup to create an underpressure in the recess that assists in driving the gabled bottom of the carton into engagement with the anvil thereby to form the generally flattened seating area;

heating means disposed above the cup for pre-heating the gabled bottom of the carton prior to engagement between the gabled bottom of the carton and the anvil thereby to facilitate heat sealing of the generally flattened seating area; and drive means for moving the cup between a first position distal the heating means and a second position proximate the heating means.

24. An apparatus for forming a generally flattened seating area from a gabled bottom of a carton, the apparatus comprising:

an underpressure source;

a cup having a recess for receiving a carton, the recess having a shape generally corresponding to the carton, the cup further including an inlet in fluid communication with the recess and the underpressure source;

an anvil disposed in the recess, the canon forming a seal with the cup to create an underpressure in the recess that assists in driving the gabled bottom of the carton into engagement with the anvil thereby to form the generally flattened seating area;

an ejecting mechanism connected to the anvil, the ejecting mechanism comprising a piston connected to the anvil and slidably disposed through an aperture in the cup, the piston extending from the cup to form a bumper, a strike plate disposed below bumper, drive means for creating relative movement between the strike plate and bumper, relative movement between the strike plate and the bumper causing the piston to drive upward into the cup to eject the carton.

25. An apparatus as claimed in claim 24 wherein the drive means is a linear actuator that moves the cup from a first position at which the bumper is distal the strike plate to a second position at which the bumper engages the strike plate.

26. An apparatus for forming a generally flattened seating area from a gabled bottom of a carton having an extending fin, the apparatus comprising:

an underpressure source;

a cup having a recess for receiving a carton, the recess having a shape generally corresponding to the carton, the cup further including an inlet in fluid communication with the recess and the underpressure source, the cup further comprising a base member, and an removable upper member, the removable upper member being interchangeable to accommodate different canon cross-sections; and an anvil disposed in the recess, the carton forming a seal with the cup to create an underpressure in the recess that assists in driving the gabled bottom of the canon into engagement with the anvil thereby to form the gabled bottom including the extending fin into the generally flattened seating area.

27. An apparatus for forming a generally flattened seating area from a gabled bottom of a carton in a plurality of canons, the apparatus comprising:

an underpressure source;

a cup array having a plurality, of cups, each of the cups having a recess for receiving a respective carton, the recess having a shape generally corresponding to the carton, the cup further including an inlet in fluid communication with the recess and the underpressure source;

a plurality of anvils, each anvil respectively disposed in the recess of a respective cup of the cup array, the respective carton forming a seal with the cup to create an underpressure in the recess that assists in driving the gabled bottom of the respective carton into engagement with the anvil thereby to form the generally flattened seating area heating means disposed above the cup array for preheating the gabled bottoms of the cartons prior to engagement between the gabled bottoms of the cartons and the anvils thereby to facilitate heat sealing of the generally flattened seating areas;

drive means for moving the cup array between a first position distal the heating means and a second position proximate the heating means.

28. An apparatus for forming a generally flattened seating area from a gabled bottom of a carton in a plurality of cartons, the apparatus comprising:

an underpressure source;

a cup array having a plurality of cups, each of the cups having a recess for receiving a respective carton, the recess having a shape generally corresponding to the carton, the cup further including an inlet in fluid communication with the recess and the underpressure source;

a plurality of anvils, each anvil respectively disposed in the recess of a respective cup of the cup array, the respective carton forming a seal with the cup to create an underpressure in the recess that assists in driving the gabled bottom of the respective carton into engagement with the anvil thereby to form the generally flattened seating area;

ejecting means connected to the plurality of anvils for ejecting the cartons from the recesses after the generally flattened seating areas have been formed, the ejecting means comprising a plurality of pistons, each of the plurality of pistons being connected to a respective one of the plurality of anvils, each of the pistons being slidably disposed through an aperture in the respective cup, each of the plurality of pistons extending from the respective cup to form a bumper, a strike plate disposed below the bumpers, drive means for creating relative movement between the strike plate and the bumpers, relative movement between the strike plate and the bumpers causing the pistons to drive upward into the cups to eject the cartons.

29. An apparatus as claimed in claim 28 and further comprising:

a piston bracket connecting at least two adjacent pistons;

a guide rod connected to the piston bracket at a first end thereof and extending through an aperture in the strike plate at a second end thereof for sliding engagement between the strike plate and guide rod, the second end of the guide rod having a stop member to prevent the guide rod from being disengaging from the aperture.

30. An apparatus as claimed in claim 28 wherein the drive means is a linear actuator that moves the cup array from a first position at which the bumper is distal the strike plate to a second position at which the bumper engages the strike plate.

31. An apparatus as claimed in claim 29 wherein the drive means is a linear actuator that moves the cup array from a first position at which the bumper is distal the strike plate to a second position at which the bumper engages the strike plate.

32. An apparatus for forming a generally flattened seating area from a gabled bottom of a carton in a plurality of cartons, the apparatus comprising:

an underpressure source;

a cup array having a plurality of cups, each of the cups having a recess for receiving a respective carton, the recess having a shape generally corresponding to the carton, the cup further including an inlet in fluid communication with the recess and the underpressure source, the cup array comprising a base member forming the bottom of the cups of the cup array, and a removable upper member forming the sidewalls of the cups of the cup array, the removable upper member being interchangeable to accommodate different size cartons; and a plurality of anvils, each anvil respectively disposed in the recess of a respective cup of the cup array, the respective carton forming a seal with the cup to create an underpressure in the recess that assists in driving the gabled bottom of the respective carton into engagement with the anvil thereby to form the gabled bottom including the extending fin into the generally flattened seating area.

* * * * *

UNITED STATES PATENT AND TRADEMARK OFFICE

CERTIFICATE OF CORRECTION

PATENT NO. : 5,551,211

DATED : September 3, 1996

INVENTOR(S) : Paul Kennedy, Richard Prochut, Jörgen Löfstedt, Ikuro Yokoyama, Christer Nilsson It is certified that error appears in the above-indentified patent and that said Letters Patent is hereby corrected as shown below:

IN COLUMN 2, LINE 46

After "FIG." insert --1.--.

IN COLUMN 8, LINE 51

Cancel "carton/forming" and insert --carton forming-- therefor.

IN COLUMN 11, LINE 21

Cancel "canon" and insert --carton-- therefor.

IN COLUMN 11, LINE 54

Cancel "canon" and insert --carton-- therefor.

IN COLUMN 11, LINE 57

Cancel "canon" and insert --carton-- therefor.

IN COLUMN 11, LINE 63

Cancel "canons" and insert --cartons-- therefor.

Signed and Sealed this

Thirty-first Day of December, 1996

*Attest:*

Bruce Lehman

BRUCE LEHMAN

*Attesting Officer*

*Commissioner of Patents and Trademarks*